United States Patent [19]

Sweany

[11] Patent Number: 4,581,496

[45] Date of Patent: Apr. 8, 1986

[54] DIAPHRAGM FOR ATTENUATING HARMONIC RESPONSE IN AN ELECTROACOUSTIC TRANSDUCER

[75] Inventor: Louis P. Sweany, Carmel, Ind.

[73] Assignee: Emhart Industries, Inc., Indianapolis, Ind.

[21] Appl. No.: 72,403

[22] Filed: Sep. 4, 1979

[51] Int. Cl.[4] ..... H04R 7/26

[52] U.S. Cl. ..... 179/181 R; 181/166

[58] Field of Search ..... 179/181 R, 181 F, 181 W; 181/165, 166, 167–174

[56] References Cited

U.S. PATENT DOCUMENTS

| | | | |
|---|---|---|---|
| 1,040,294 | 10/1912 | Hoffman et al. | 181/167 |
| 1,757,451 | 5/1930 | Crane | 181/166 |
| 1,882,974 | 10/1932 | Schlenker | 181/168 |
| 1,918,422 | 7/1933 | Nystrom | 181/168 |
| 1,990,409 | 2/1935 | Lawrance | 181/173 |
| 1,997,790 | 4/1935 | Heidrich | 181/163 |
| 2,815,823 | 12/1957 | Olson et al. | 179/181 R |
| 3,464,514 | 9/1969 | Mochida et al. | 179/181 F |
| 3,549,829 | 12/1970 | Heidrich | 181/166 |

*Primary Examiner*—Donnie L. Crosland
*Attorney, Agent, or Firm*—Robert F. Meyer

[57] ABSTRACT

A circular diaphragm typically edge mounted to the housing of an electroacoustic transducer includes a plurality of inwardly curved slots isolated by a circular ridge formed in the diaphragm to thereby increase the compliance of the diaphragm at the center of the circular ridge. Portions of the slots are overlapped to maintain a substantially rectangular section of the diaphragm between the slots. The slotting and rectangular sections of the diaphragm allow the center of the circular ridge to flex in a piston-like manner whereby higher frequency flexural modes of the diaphragm are either reduced or completely eliminated.

8 Claims, 3 Drawing Figures

DIAPHRAGM FOR ATTENUATING HARMONIC RESPONSE IN AN ELECTROACOUSTIC TRANSDUCER

In general, the present invention relates to electroacoustic transducers for producing an audible signal of the type which include a housing, a coil assembly positioned in the housing, and a diaphragm edge mounted to a flange on the housing whereby the coil assembly excites the diaphragm to vibrate at a desired frequency. In particular, the invention includes a diaphragm for attenuating harmonics associated with the desired frequency of vibration of the diaphragm.

One of the problems associated with conventional edge-mounted circular diaphragms in electroacoustic transducers is that when the diaphragms are excited to vibration they are susceptible to a number of vibrational modes which appear as harmonics (higher frequencies) of the desired frequency of vibration. The magnitude of these harmonic responses is further affected by variations in stresses placed upon the diaphragm. These stresses have been difficult to control leading to difficulty in controlling the harmonic content of the desired frequency of vibration of the diaphragm.

Further, electrical circuits used to apply an input electrical signal to low cost electroacoustic transducers which include edge-mounted circular diaphragms should also be low cost which may preclude the use of relatively high cost sine wave oscillators to apply to such transducers an input signal of low harmonic content. On the other hand, the use of relatively low cost square wave oscillators to apply to such transducers an input signal tends to increase the harmonic content of the desired frequency of vibration of such transducer. Therefore, of particular interest is a transducer capable of minimizing the harmonic content of the desired frequency of vibration when a square wave oscillator is used to apply the input signal to the transducer.

As disclosed in U.S. Pat. Nos. 1,997,790; 1,990,409; and 1,040,294 and in German Pat. No. 667,495, diaphragms typically used with electroacoustic transducers have heretofore been slotted in different fashions to accomplish various objectives with respect to the operation of the transducer.

In accordance with the present invention, there is provided an improved diaphragm for use in an electroacoustic transducer for attenuating the harmonic content of a desired frequency of vibration of the diaphragm which, among other things, employs a unique slotting arrangement to accomplish the objectives of the invention.

The diaphragm of the present invention includes a planar substrate having a plurality of inwardly curved slots wherein the slots are isolated by a circular ridge formed in the substrate to thereby increase the compliance of the substrate at the center of the circular ridge.

Therefore, an objective of the present invention is to allow the center of the diaphragm within the circular ridge to flex like a piston so that higher frequency flexural modes of vibration are either reduced or eliminated.

By isolating a portion of the diaphragm, the flexural vibration of the diaphragm at the center of the isolated portion is controllable and therefore stresses associated with remaining portions of the diaphragm are substantially eliminated.

Further provided by the present invention is a method of attenuating harmonics of a desired frequency of vibration of a diaphragm used in an electroacoustic transducer which includes the steps of isolating a portion of the diaphragm to be vibrated and slotting the isolated portion to allow greater flexibility of the center thereof.

Although the features described hereinabove are considered to be the most important, other features and advantages of the present invention will be apparent from the following detailed description of an embodiment thereof, which description should be considered in conjunction with the accompanying drawings in which.

Figure 1:
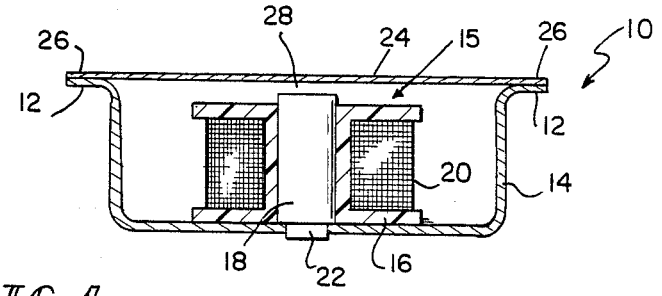
FIG. 1 PRIOR ART
FIG. 1 is a cross-sectional view of a conventional electroacoustic transducer having an edge-mounted diaphragm.

Referring now to the drawings, and in particular to FIG. 1, a conventional electroacoustic transducer 10 for producing an audible signal is shown as including a circular housing 14 having a cup shape. However, the shape of the housing may vary in accordance with the manufacturer of the transducer 10. In most conventional transducers 10, the housing will be constructed of steel and include an outwardly protruding flange 12 around the periphery of the housing for mounting a diaphragm 24 at its edges 26. A coil assembly 15 will be positioned within the housing and in response to an electrical signal excite the diaphragm 24 to vibrate at a desired frequency utilizing electromagnetic forces produced by the coil assembly 15. The coil assembly 15 will typically include a coil bobbin 16 having a core 18 and a wire coil 20 wound around the core 18 on the bobbin 16. It should be noted that the dimensions of the bobbin 16 and the core 18 will vary depending upon the manufacturer of the transducer 10 and further that the number of turns and type of wire used for the coil will also vary. A stake 22 engages the housing 14 to hold the coil assembly 15 in place within the housing 14. It should further be noted that an air gap 28 is provided between the core 18 and the diaphragm 24 to allow the diaphragm 24 to vibrate freely in response to the electromagnetic forces produced by the coil assembly 15. Again, the width of the air gap 28 will depend upon the manufacturer of the transducer 10. As shown in FIG. 1, the flat top surface of the core 18 may be utilized to excite the diaphragm 24, or the core 18 may be provided with a post (not shown) protruding upwardly to establish the necessary air gap 24 between the coil assembly 15 and the diaphragm 24.

The diaphragm 24 is typically of a circular steel construction having dimensions corresponding to the dimensions of the housing 14. For purposes of the present invention, a diaphragm having a thickness of approximately 0.006 inches was utilized. The edge mounting of the diaphragm will, in most instances, be accomplished by welding the diaphragm to the flange 12 at various points around the circumference of the diaphragm 24.

Figure 2:
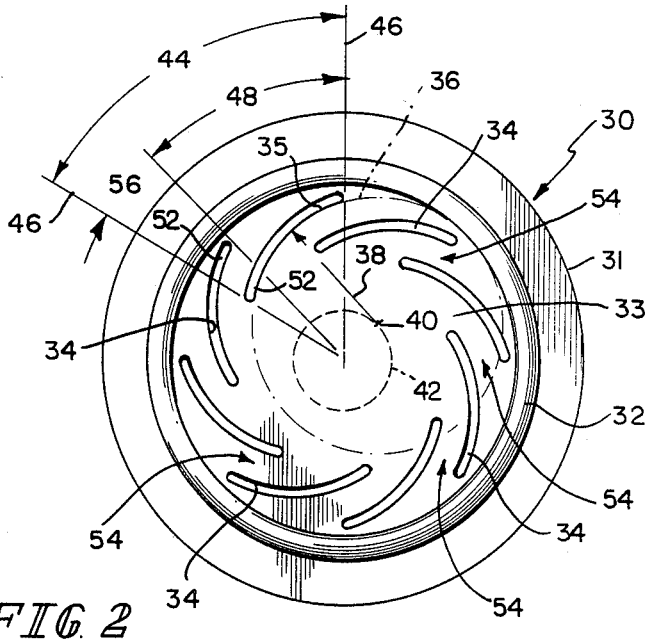
FIG. 2 is an elevational view of a diaphragm constructed in accordance with the present invention.
Figure 3:
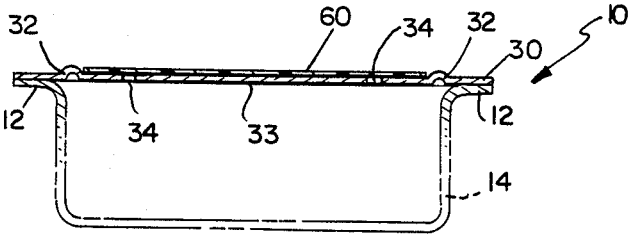
FIG. 3 is a cross-sectional view of the housing of the transducer shown in FIG. 1 illustrating the mounting of the diaphragm shown in FIG. 2.

Illustrated in FIG. 2 is a diaphragm 30 constructed in accordance with the present invention for attenuating the harmonic content of a desired frequency of vibration of the diaphragm 30 when employed in the conventional electroacoustic transducer 10 described hereinabove. The diaphragm 30 includes a circular planar substrate 31 constructed of steel. As best illustrated in FIG. 3, the substrate 31 has formed therein a circular ridge 32 for isolating a central portion 33 of the substrate 31 which is to be vibrated. It should be noted that the circular ridge 32 has a diameter which is less than the inner diameter of the housing 14, as best illustrated in FIG. 3. Accordingly, any effects such as stresses which may be associated with the edge mounting of the diaphragm 30 to the housing 14 are substantially eliminated by the isolation ridge 32. Within the isolated center portion 33 of the substrate 31 there are provided eight inwardly curving slots 34. Each slot 34 is struck along an arc 35 of a circle 36 having a radius 38. The center 40 of each circle 36 is located on the circumference of a circle 42 drawn concentric to the circular ridge 32 and the circular substrate 31. Each inwardly curving slot 34 subtends an angle 44 of 60° formed by radii 46 of the circular ridge 32 (or the circular substrate 31). Importantly, the radii 38 of the circles 36 have lengths which are less than the radius of either the circular ridge 32 or the circular substrate 31. Further, the centers 40 of each circle are equally spaced around the circumference of the concentric circle 42 such that an arc connecting two center points 40 on the circumference of the circle 42 subtends an angle 48. In the preferred embodiment, this angle 48 is 45°. End portions 52 of the slots 34 are overlapped in spaced relation to each other so that a rectangular area 54 of the substrate 31 is maintained between the overlapping slots 34. An angle 56 of preferably 15° is coincidentally subtended by the overlapping end portions 52 of slots 34. It can therefore be seen that when the isolated center portion 33 of the diaphragm 30 is vibrated, most of the flexing of the diaphragm 30 occurs at the rectangular areas 54, causing the central portion 33 to flex in a piston-like manner and thereby reducing the tendency for the central portion 33 to respond to harmonic frequencies. The isolated center portion 33 of the diaphragm 30 therefore has a higher degree of flexibility and a greater compliance than the conventional diaphragm 24 shown in FIG. 1.

Referring to FIG. 3, a thin material 60 is in contact with the isolated central portion 33 of the diaphragm to cover the slots 34 and thereby prevent air from passing through such slots 34 when the diaphragm 30 is vibrated. This thin material may be an adhesive tape such as a thin mylar material having a thickness of approximately 0.001 inches.

For comparison, the following data was taken from a conventional electroacoustic transducer 10 having first an unslotted diaphragm 24 edge mounted to the housing 14 and second a slotted diaphragm 30 constructed in accordance with the present invention edge mounted to the transducer 10. In order to analyze the data provided hereinbelow, it should be noted that an objective of the present invention was to reduce the harmonic frequencies associated with the fundamental frequency of the conventional diaphragm 24 to a much lower dB level than the dB level of the fundamental frequency so that their effect on the audible signal produced is decreased. Accordingly, the data provided below shows the dB level of the fundamental frequency (approximately 1 KHZ) and the difference between the dB level of the fundamental frequency and the dB level of a plurality of harmonics of the fundamental frequency. As shown by the data, the slotted diaphragm 30 of the present invention consistently produces lower harmonic dB levels than the conventional diaphragm 24, and therefore the slotted diaphragm 30 produces an audible signal having less harmonic content using a square wave generator to apply an input signal to each type of transducer.

| UNSLOTTED CONVENTIONAL DIAPHRAGM | | SLOTTED DIAPHRAGM WITH .001 INCH MYLAR TAPE COVER | |
|---|---|---|---|
| f (cps) | dB | f (cps) | dB |
| 1010 | 71.5 | 1010 | 73 |
| 2020 | +0.5 | 2018 | −20 |
| 3030 | −14 | 3026 | −32 |
| 4038 | −20 | 4035 | −30 |
| 5047 | +5 | 5043 | −50 |
| 6057 | −33 | 6051 | −60 |
| 7065 | −41 | 7060 | −58 |
| 8074 | −37 | 8068 | −60 |
| 9083 | −36 | 9076 | −60 |
| 10092 | −42 | 10085 | −60 |

What is claimed is:

1. A diaphragm for use in an electroacoustic transducer to attenuate the harmonic content of a desired frequency of vibration, comprising a planar substrate including a circular isolating ridge surrounding a central portion and means for allowing said central portion to vibrate in a piston-like manner, said means for allowing including a plurality of inwardly curved slots surrounding said central portion with each said slot having opposite end portions angularly overlapping and in spaced relation to the end portions of adjacent slots, said angularly overlapping end portions forming a plurality of substantially rectangular areas of said substrate therebetween to allow most of the flexing of said substrate to occur in said substantially rectangular areas and thereby allow said central portion to vibrate in a piston-like manner.

2. The diaphragm of claim 1, wherein said slots are of equal length and equally spaced around said central portion to cause each slot to subtend an angle of said circular ridge which angle is greater than 360° divided by the number of slots.

3. The diaphragm of claim 2, wherein there are eight slots angularly spaced 45° apart around said central portion with each of said rectangular areas subtending angles of 15° of said circular ridge.

4. The diaphragm of claim 1, wherein each of said slots has one end thereof located in close proximity to said circular ridge.

5. The diaphragm of claim 4, wherein each of said one ends of said slots are equally angularly spaced around said circular ridge.

6. A method of attenuating harmonics of a desired frequency of vibration of a planar diaphragm in an electroacoustic transducer comprising the steps of isolating a portion of said planar diaphragm by forming a circular ridge therein and enabling a central portion of said diaphragm within said circular ridge to vibrate in a piston-like manner by surrounding said central portion with a plurality of inwardly curved slots each having opposite end portions angularly overlapping and in spaced relation to the end portions of adjacent slots, said angularly overlapping end portions forming a plurality of substantially rectangular areas of said diaphragm therebetween to allow most of the flexing of said diaphragm to occur in said substantially rectangular areas.

7. The method of claim 6, wherein said slots are each formed with one end located in close proximity to said circular ridge.

8. The method of claim 6, wherein said slots are formed with equal length and equally angularly spaced around said central portion.

* * * * *